US008085259B2

(12) United States Patent
Kubota et al.

(10) Patent No.: US 8,085,259 B2
(45) Date of Patent: Dec. 27, 2011

(54) DISPLAY APPARATUS

(75) Inventors: Hidenao Kubota, Yokohama (JP); Yuzo Nishinaka, Chigasaki (JP); Yutaka Yamada, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 434 days.

(21) Appl. No.: 12/429,247

(22) Filed: Apr. 24, 2009

(65) Prior Publication Data

US 2010/0053140 A1 Mar. 4, 2010

(30) Foreign Application Priority Data

Aug. 28, 2008 (JP) ..... 2008-219283

(51) Int. Cl.
*G09G 5/00* (2006.01)

(52) U.S. Cl. ..... 345/211; 345/101; 362/365; 362/373; 349/161

(58) Field of Classification Search ..... 345/101, 345/204, 211, 212; 362/365, 373; 361/688; 349/161; 399/94; 307/126; 248/346.03
See application file for complete search history.

(56) References Cited

U.S. PATENT DOCUMENTS

| | | | | |
|---|---|---|---|---|
| 7,688,280 | B2 * | 3/2010 | Callegari et al. | 345/1.3 |
| 7,990,344 | B2 * | 8/2011 | Maeda et al. | 345/63 |
| 2006/0279189 | A1 | 12/2006 | Jeong | |

FOREIGN PATENT DOCUMENTS

| | | |
|---|---|---|
| JP | 2006-337776 | 12/2006 |
| JP | 2006-337982 | 12/2006 |

* cited by examiner

*Primary Examiner* — Abbas Abdulselam
(74) *Attorney, Agent, or Firm* — Antonelli, Terry, Stout & Kraus, LLP.

(57) ABSTRACT

The present invention improves the reliability of a display apparatus by suppressing the temperature rise of the display apparatus mounted on a wall. The display apparatus is provided with a wall mount switch to detect a wall mount member if the wall mount member is attached to the rear of the display apparatus. If it is detected by the wall mount switch that the display apparatus is mounted on a wall, the display power supplied to a display unit is set lower than normal by a power controller. This suppresses the temperature rise of the apparatus mounted on a wall.

4 Claims, 4 Drawing Sheets

DISPLAY APPARATUS

CLAIM OF PRIORITY

The present application claims priority from Japanese patent application serial No. JP 2008-219283, filed on Aug. 28, 2008, the content of which is hereby incorporated by reference into this application.

BACKGROUND OF THE INVENTION

1. Field of the Invention

The present invention relates to a display apparatus which display images by using plasma display panels (PDPs), liquid crystal displays (LCDs) and the like and, in particular, to a display apparatus which suitably suppresses the temperature rise thereof if mounted on a wall.

2. Description of the Related Art

In response to digital high definition television broadcasts, recent television receivers have advanced toward higher quality and larger screen ones by using such thin display devices as PDPs and LCDs. Also in terms of installation for practical use, wall-mounted TV sets have appeared in addition to those supported by television stands which are set on floors. For use in the wall-mounted state, display apparatus are more seriously required to be thinner and lighter.

In each of JP-A-2006-337776 and JP-A-2006-337982, a placing structure is described which allows a display apparatus to be placed either on a TV stand or on a wall.

SUMMARY OF THE INVENTION

Enlarging the screen of a display apparatus (also denoted as a TV set or simply as a set) increases the power dissipation and heat generation of the display unit (panel unit). Meanwhile, making thinner the display apparatus lowers the heat radiation efficiency. This is because the display apparatus contains not only the display unit but also such heat generating components as transformers and driver ICs which are difficult to reduce in size. Although these heat generating components are cooled by air circulation within the display apparatus, thinning the display apparatus makes it necessary for them to be arranged with less space. Since air circulation paths are blocked, effective cooling is difficult.

Further, mounting the display apparatus on a wall is a disadvantage in the external cooling of the TV set since just a small space of, for example, about 2 cm, is left between the rear of the TV set and the wall while a space of about 10 to 15 cm at least is left therebetween if placed on a stand. Thus, in the wall-mounted state, cooling of the display apparatus by convection at the rear thereof may be so insufficient as to raise the internal temperature of the set higher than tolerated. This may deteriorate the performance and reliability of the set. That is, this temperature rise must be considered when a thin set is mounted on a wall.

In either JP-A-2006-337776 or JP-A-2006-337982, cited above, no particular consideration is given to the temperature rise of the set mounted on a wall.

It is an object of the present invention to suppress the temperature rise of a display apparatus mounted on a wall and consequently improve the reliability of the display apparatus.

To solve the above-mentioned problem, a display apparatus of the present invention comprises: a placed state detector which detects whether the display apparatus is in a first placed state or in a second placed state, the first placed state meaning that the display apparatus is placed by a stand supporting the display apparatus from below, the second placed state meaning that the display apparatus is placed by a wall mounting member attached to the rear of the display apparatus; and a power controller which controls the display power supplied to the display unit according to the placed state of the display apparatus detected by the placed state detector, wherein the display power supplied to the display unit is controlled by the power controller such that the display power supplied to the display unit when the display apparatus is in the second placed state detected by the placed state detector is set lower than the display power supplied to the display unit when the display apparatus is in the first placed state detected by the placed state detector.

The placed state detector may be a wall mount switch detecting the wall mount member if attached to the rear of the display apparatus. Alternatively, the placed state detector may also be a stand detecting sensor detecting the stand if inserted into the bottom of the display apparatus.

According to the present invention, it is possible to improve the reliability of a display apparatus by preventing its temperature from rising higher than tolerated regardless of how the display apparatus is installed. In addition, according to the present invention, it is possible to reduce the power consumption when the display apparatus is mounted on a wall.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE EMBODIMENT

Based on the drawings, the embodiment of the present invention will be described below.

Figure 1A:
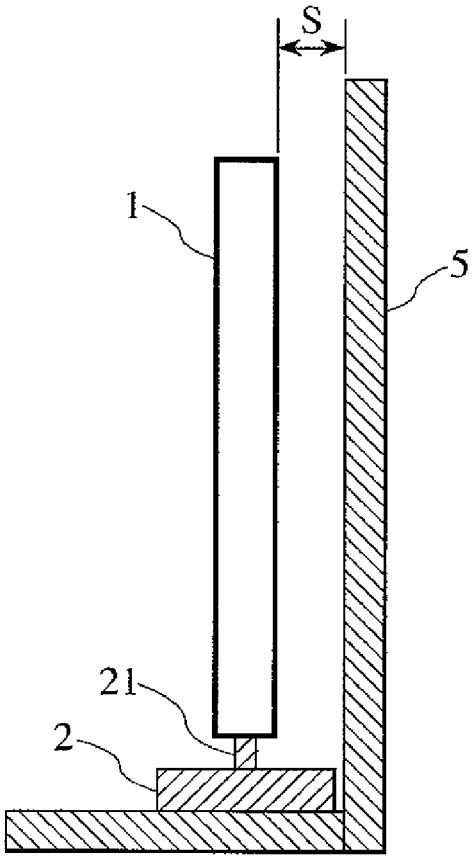
FIGS. 1A and 1B illustrate two ways of installing a display apparatus of the present invention.
Figure 1B:
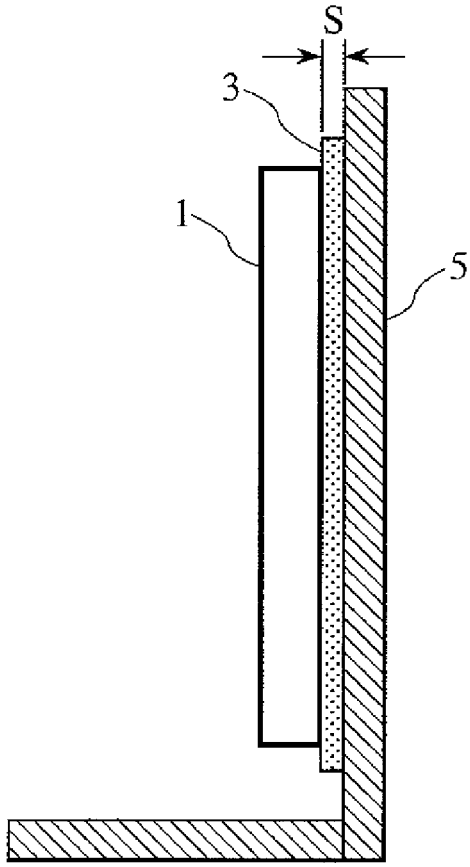

FIGS. 1A and 1B illustrate two ways of installing a display apparatus of the present invention.

FIG. 1A illustrates a first way of installation or floor placing. Into the bottom of the display apparatus (set) 1, a support member 21 of a TV stand 2 is inserted so that the TV stand 2 supports the set 1 from below. In this case, if the stand 2 has a width of about 30 cm, a space of at least 10 to 15 cm is kept between the rear of the set 1 and a wall 5.

FIG. 1B illustrates a second way of installation or wall mounting. The set 1 is fixed to the wall 5 with wall mounting member 3. In this case, a space S of, for example, about 2 cm is kept between the rear of the set 1 and the wall 5. The space S between the set 1 and the wall 5 constitutes the heat radiation space of the set 1. If the set 1 is mounted on a wall as shown in FIG. 1B, this heat radiation space is very narrow, lowering the efficiency of cooling the rear of the set 1.

Figure 2A:
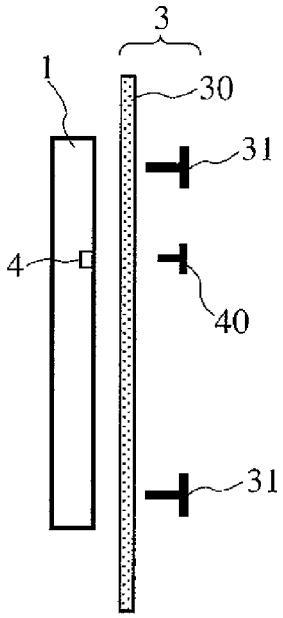
FIGS. 2A through 2C are side and rear views of a display apparatus in accordance with an embodiment of the present invention.
Figure 2B:
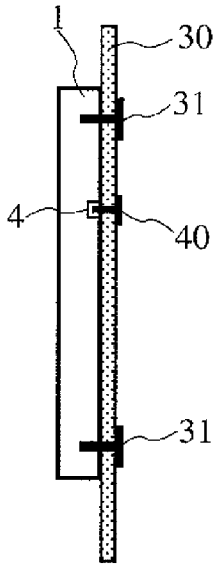
Figure 2C:
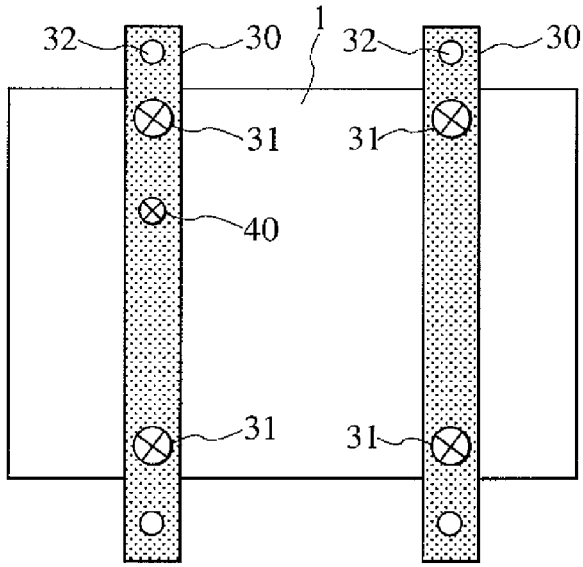

FIGS. 2A through 2C provide side and rear views of a display apparatus in accordance with an embodiment of present invention.

FIG. 2A is a side view of the display apparatus (set) 1 before the display apparatus (set) 1 is attached to the wall mounting member 3. Likewise, FIG. 2B is a side view of the set 1 after attached to the wall mounting member 3. FIG. 2C is a rear view of the set 1 after attached to the mounting member 3. The mounting member 3 comprises, for example, two support frames 30. After the set 1 is attached to the support frames 30 with fixing screws 31, the support frames 30 are fixed to the wall 5 by using fixing holes 32.

The display apparatus in accordance with the present embodiment has a wall mount switch 4 provided on the rear thereof to detect the wall mounting member 3 (support frame 30) attached thereto. On the other hand, to turn on/off the switch 4, the wall mount member 3 has a boss 40 located so as to face the wall mount switch 4. The boss 40 may be, for example, a screw built into a support frame 30. The actuation point of the switch 4 can be adjusted as appropriate by increasing/decreasing the projection of the screw's tip. More than one boss 40 is not required for the associated wall mount switch 4.

Figure 3:
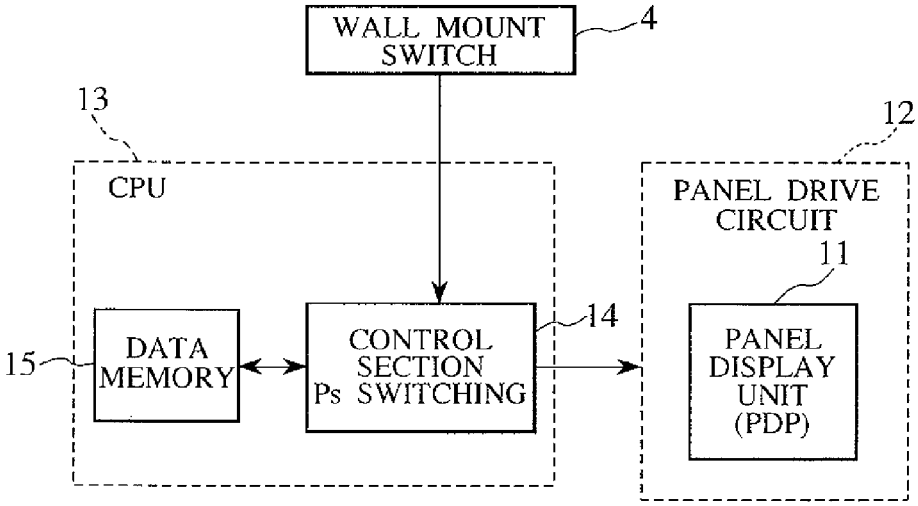
FIG. 3 illustrates an example of a circuit configuration of a display apparatus in accordance with the present embodiment.

FIG. 3 illustrates an example of a circuit configuration of a display apparatus in accordance with the present embodiment. The circuit configuration in this figure assumes a PDP-used display apparatus.

The display apparatus 1 comprises a panel display unit (PDP) 11, a panel drive circuit 12 to drive the PDP 11, and a CPU (central processing circuit) 13 to control the panel drive circuit 12. The CPU 13 has a control section 14 to control the panel display unit 14, and a data memory 15 to store control data. In the present embodiment, a control signal from the wall mount switch 4 is input to the control section 14 which in turn controls the display power supplied to the panel display unit 11. Specifically, if it is detected from the signal of the wall mount switch 4 that the set 1 is in the wall-mounted state, the control section 14 reduces the display power supplied to the panel display unit 11.

In the case of a PDP-used display apparatus as in this figure, the main discharge power Ps is switched from the normal level to a lower level. This reduces the amount of heat released from the panel and suppresses the internal temperature rise of the set to a tolerable level. The reduction of the discharge power Ps is optimally determined based on the preliminary measured relation between the temperature rise and the discharge power Ps in the wall mounted state. The determined discharge power is stored in the data memory 15. For example, in the case of a 50-inch PDP whose discharge power is normally set to 400 W, it is found desirable to reduce the power to about 350 W in the wall-mounted state.

In the case of a LCD-used display apparatus, it is similarly possible to suppress the internal temperature rise of the set to a tolerable level by reducing the backlight current or the voltage supplied to the backlight (CCFL, EEFL or other cold cathode tube, light-emitting diode or the like) instead of the discharge power Ps.

Figure 4:
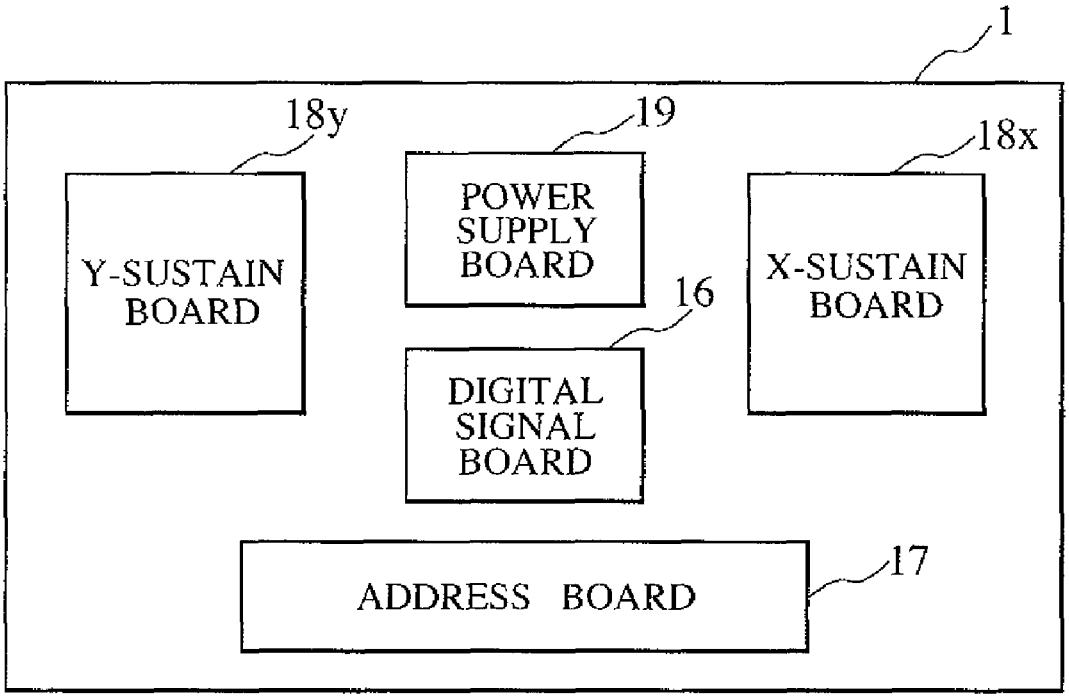
FIG. 4 illustrates an example of layout of boards in a display apparatus in accordance with the present embodiment.

FIG. 4 illustrates an example of layout of boards in a display apparatus in accordance with the present embodiment. In this figure, the layout of boards in a PDP-used display apparatus is viewed from the rear side. These boards constitute a drive circuit to drive the front display unit. An external image signal enters a digital signal board 16 which converts the image signal to panel display data and supplies the panel display data to an address board 17, X sustain board 18*x* and Y sustain board 18*y*. The address board 17 accumulates wall charges at specified address electrodes. The sustain boards 18*x* and 18*y* sustain light emission for a given time period. A power supply board 19 supplies power to the other boards. At the rear of the set, these boards serve as heat generating sources.

Figure 5:
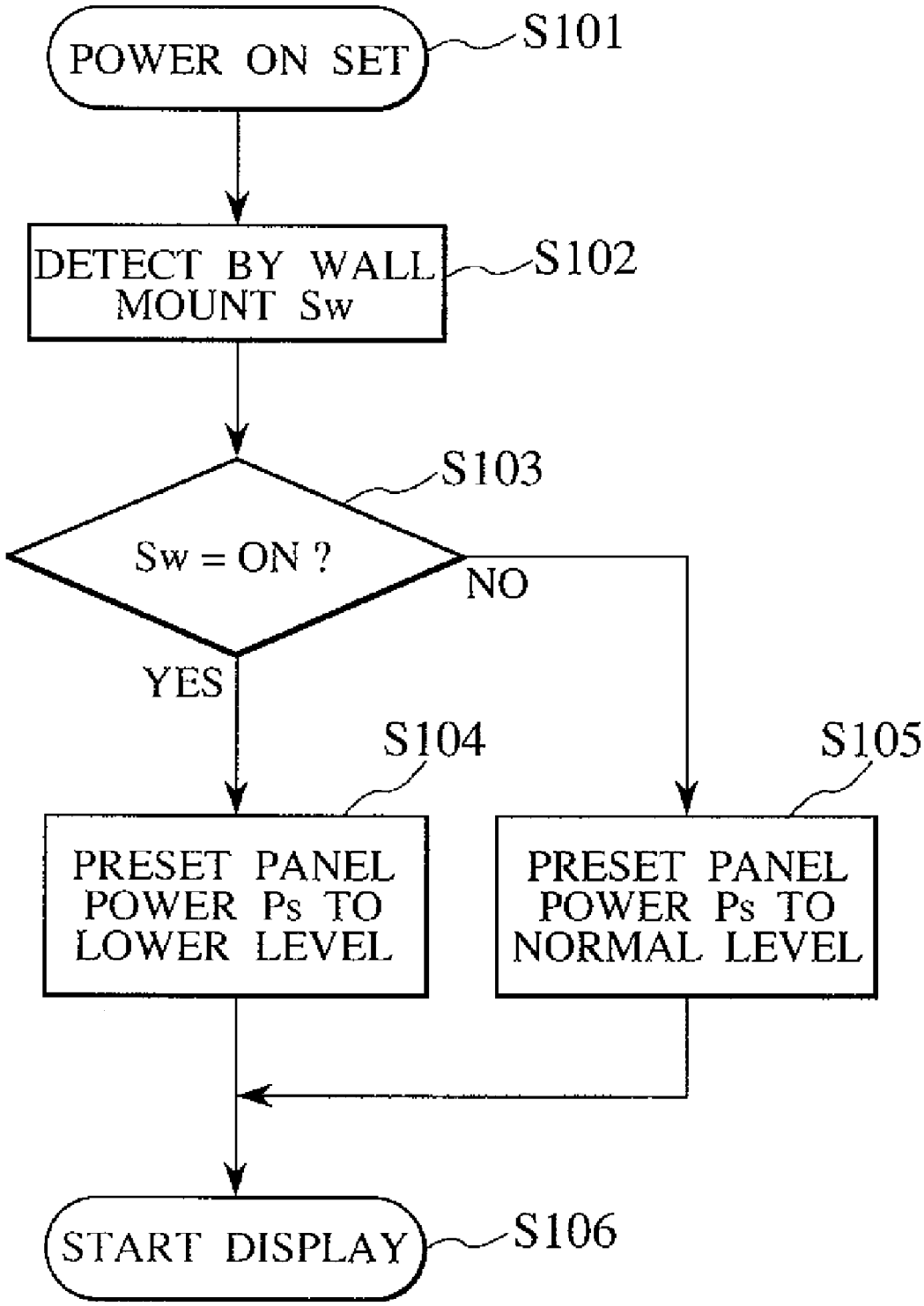
FIG. 5 is a flowchart indicating the power switching control of a display apparatus in accordance with the present embodiment.

FIG. 5 is a flowchart indicating the power switching control of the display apparatus in accordance with the present embodiment.

If the display apparatus (set) is powered on at S101, the signal (ON/OFF signal) from the wall mount switch 4 of the set 1 is detected at S102. The signal from the wall mount switch 4 is examined at S103. If the switch is ON, it is judged that the set 1 is in the wall-mounted state and then the control section 14 presets a lower level as the power (discharge power Ps) to the panel display 11 at S104. If the switch is OFF, it is judged that the set 1 is in the stand-placed state and then the power is preset to the normal level at S105. At the preset power, images begin to be displayed at S106.

The embodiment described so far is fundamental in configuration and operation and may be modified as below.

(1) The placed state of the set 1 is recognized by detecting whether the set 1 is supported by the TV stand 2 instead of using the wall mount switch 4. For example, a light sensor (stand detection sensor) is disposed at the bottom of the set, opposite to the display unit (panel) and close to the position where the support member 21 of the stand 2 is to be inserted. The light sensor detects light leak from the panel. Since this light leak is blocked before the light sensor if the support member is inserted, it is possible to recognize whether the set is placed on the stand 2.

(2) The placed state of the set is recognized by using a known distance sensor. The distance sensor is disposed at the rear of the set 1 to detect the space S between the rear of the set 1 and the wall 5. If the detected space S is not larger than a predefined distance (for example, 2 cm), it is judged that the set 1 is mounted on a wall. In this case, the display power is reduced as mentioned above. If the detected space S is larger than the predefined distance, it is judged that the set 1 is installed on a floor. In this case, the power is preset to the normal level.

(3) The set, although mounted on a wall, can be inclined from the wall. Since the space between the rear of the set and the wall is widened, this inclination improves the cooling efficiency and reduces the temperature rise. Accordingly, the power supplied to the panel is changed in stages depending on the amount of inclination (angle of inclination) of the display unit (panel). This enables finer control.

(4) Not like a typical large television set where the tuner unit is separated from the display unit (monitor unit) and the power to the panel is controlled by a CPU incorporated in the display unit, the power to the panel is controlled by the turner unit. The internal CPU of the tuner unit controls the power according to the signal input thereto from the wall mount switch (or light sensor).

(5) A temperature sensor is additionally used. The power supplied to the panel is restricted according to the difference between the highest allowable temperature and the internal (or surface) temperature of the set detected by the temperature sensor. This can further improve the reliability of the set since the temperature of the set does not exceed the highest allowable temperature even if the ambient environment is subject to change.

As described so far, the configuration of the present embodiment makes it possible to prevent the temperature of a display apparatus from rising higher than tolerated regardless of how the display apparatus is installed. In addition, the power consumption is reduced in the wall-mounted state. The present invention is widely applicable to wall-mountable display apparatus which use PDP, LCD and other thin display devices.

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications that fall within the ambit of the appended claims.

What is claimed is:

1. A display apparatus provided with a display unit to display images, comprising:

a placed state detector which detects whether the display apparatus is in a first placed state or in a second placed state, the first placed state meaning that the display apparatus is placed by a stand supporting the display apparatus from below, the second placed state meaning that the display apparatus is mounted by a wall mounting member attached to the rear of the display apparatus; and a power controller which controls the display power supplied to the display unit according to the placed state of the display apparatus detected by the placed state detector;

wherein the display power supplied to the display unit is controlled by the power controller such that the display power supplied to the display unit when the display apparatus is in the second placed state detected by the placed state detector is set lower than the display power supplied to the display unit when the display apparatus is in the first placed state detected by the placed state detector.

2. The display apparatus according to claim 1 wherein the placed state detector is a wall mount switch detecting the wall mount member if attached to the rear of the display apparatus.

3. The display apparatus according to claim 1 wherein the placed state detector is a stand detecting sensor detecting the stand if inserted into the bottom of the display apparatus.

4. A display apparatus provided with a display unit on the front side to display images and a drive circuit on the rear side to drive the display unit, the display apparatus comprising:

a stand which places the display apparatus on a floor by supporting the bottom of the display apparatus;

a wall mounting member which is attached to the rear of the display apparatus and mounts the display apparatus on a wall;

a placed state detector which detects whether the display apparatus is placed on a floor or mounted on a wall; and a power controller which controls the display power supplied to the display unit according to a detection signal from the placed state detector;

wherein if the placed state detector detects that the display apparatus is mounted on a wall, the power controller lowers the display power supplied to the display unit.

* * * * *